US006853340B2

(12) United States Patent
Wang

(10) Patent No.: US 6,853,340 B2
(45) Date of Patent: Feb. 8, 2005

(54) ANTENNA FOR AN AUTOMOBILE

(76) Inventor: Tim Wang, No. 11, Alley 78, Lane 379, Chung Hua Rd., Shu Lin City, Taipei Hsien (TW)

( * ) Notice: Subject to any disclaimer, the term of this patent is extended or adjusted under 35 U.S.C. 154(b) by 8 days.

(21) Appl. No.: 10/375,147

(22) Filed: Feb. 28, 2003

(65) Prior Publication Data

US 2004/0169607 A1 Sep. 2, 2004

(51) Int. Cl.[7] ..... H01Q 1/32
(52) U.S. Cl. ..... 343/715; 343/888
(58) Field of Search ..... 343/715, 888, 343/880, 882, 713

(56) References Cited

U.S. PATENT DOCUMENTS 4,243,989 A * 1/1981 Piper ..... 343/715
4,785,305 A * 11/1988 Shyu ..... 343/713
5,898,408 A * 4/1999 Du ..... 343/715

* cited by examiner

*Primary Examiner*—Michael C. Wimer
(74) *Attorney, Agent, or Firm*—Rosenberg, Klein & Lee

(57) ABSTRACT

An antenna formed of a mounting base, an antenna terminal and a transmission box is described for use in an automobile. The antenna terminal is pivotally attached to the mounting base by a ball and socket joint. The mounting base has a bearing plate supported on a spring member and forced by the spring member to adjustably positively hold down the antenna terminal in position.

8 Claims, 5 Drawing Sheets

ANTENNA FOR AN AUTOMOBILE

BACKGROUND OF THE INVENTION

1. Field of the Invention

The present invention relates to antennas and, more particularly, to an antenna for mounting on the windshield for radio communication.

2. Description of the Related Art

Following the fast development of communication technology, a variety of mobile communication apparatus have been disclosed and commercialized. Further, regular automobiles commonly have an antenna for receiving radio signal.

FIG. 1 illustrates an antenna for use in an automobile. As illustrated, the antenna comprises an antenna terminal 5, a mounting base 6, and a transmission box 7. The antenna terminal 5 is a metal member having two mounting lugs 51 arranged in parallel at one end of the terminal body 50 thereof. Each mounting lugs 51 has a pivot hole 52 transversely aligned in a line. The mounting base 6 is comprised of a holder plate 60 and a connector 61. The holder plate 60 has a through hole 62. The connector 61 is made from metal, having a shaft 63 inserted through the through hole 62 of the holder plate 60 and a pivot hole 64 transversely extending through the distal end of the shaft 63 and aligned between the pivot holes 52 of the mounting lugs 51 of the antenna terminal 5. A screw bolt 53 is fastened to the pivot hole 64 of the shaft 63 and the pivot holes 52 of the mounting lugs 51 to pivotally secure the antenna terminal 5 to the holder plate 60 and the connector 61, enabling the antenna terminal 5 to be turned about the screw bolt 53 relative to the mounting base 6. A retainer ring 54 is mounted in one end of the terminal body 50 between the pivot holes 52 of the mounting lugs 51 around the threaded shank of the screw bolt 53 to hold the antenna terminal 5 in position and to allow the terminal body 50 to be turned about the screw bolt 53 by force. The transmission box 7 comprises a casing 70, a cover plate.71, a metal plate 72, and a transmission line 73. The casing 70 defines a receiving open chamber 74. The cover plate. 71 is fastened to the casing 70 to close the receiving open chamber 74, having a center wire hole 75. The metal plate 72 is located on one side of the cover plate 71 opposite the receiving open chamber 74. The transmission line 73 is received in the receiving open chamber 74, having one end inserted through the wire hole 75 and electrically connected to the metal plate 72. During installation, the mounting base 6 is mounted on the outer surface of the windshield outside the automobile, and the transmission box 7 is mounted on the inner-surface of the windshield inside the automobile opposite the mounting base 6, enabling signal to be transmitted between the transmission line 73 and the antenna terminal 5 through the connector 61 and the metal plate 72 via the windshield.

According to the aforesaid, antenna structure, the antenna terminal is pivotally fastened to the base by a screw bolt. When the automobile moves over an uneven road surface, the antenna terminal tends to vibrate and shift to a different angular position, resulting in reception failure or poor reception. When fastening the screw bolt, a screwdriver or like tool should be used. Further, the fabrication of the transmission box is complicated because a wire hole must be made in the cover plate for passing therethrough of the transmission line and the transmission line must be fastened to the metal plate by soldering when the same extends out of the cover plate through the wire hole.

for an automobile

SUMMARY OF THE INVENTION

The present invention has been accomplished with the above drawbacks in view. It is therefore the main object of the present invention to provide an antenna for an automobile, which antenna can easily be adjusted to the desired angle and position by hand without tools. It is another object of the present invention to provide an antenna for an automobile, the antenna terminal of which maintains a position of the antenna and free avoids vibration due to the automobile. It is still another object of the present invention to provide an antenna for an automobile, which antenna is easy and inexpensive to manufacture.

According to one aspect of the present invention, the antenna comprises an antenna terminal, a mounting base and a transmission box. The antenna terminal further comprises a spherical coupling portion at one end thereof. The mounting base further comprises a holder shell, an opening, a metal block and a metal spring means. The holder shell receives the spherical coupling portion of the antenna terminal. The antenna terminal extends out of the mounting base through the opening. The metal block is fixedly fastened to a bottom side of the holder shell for adhesion to an outer surface of the windshield of an automobile. The metal spring means is supported on the metal block and stopped against the spherical coupling portion of the antenna terminal to hold the spherical coupling portion of the antenna terminal in position. The transmission box comprises a metal plate adhered to an inner surface of the windshield of the automobile in which the mounting base is installed and is disposed inside the automobile opposite the mounting base. A transmission line electrically extends from the metal plate for connection to a wireless communication system inside the automobile.

According to another aspect of the present invention, the transmission box further comprises a casing and a circuit board. The casing defines a receiving open chamber, which receives the transmission line. The circuit board is mounted in the receiving open chamber of the casing and is electrically connected to the transmission line. The metal plate is built in one side of the circuit board opposite the transmission line for fastening to the inner surface of the windshield.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENT

Figure 1:
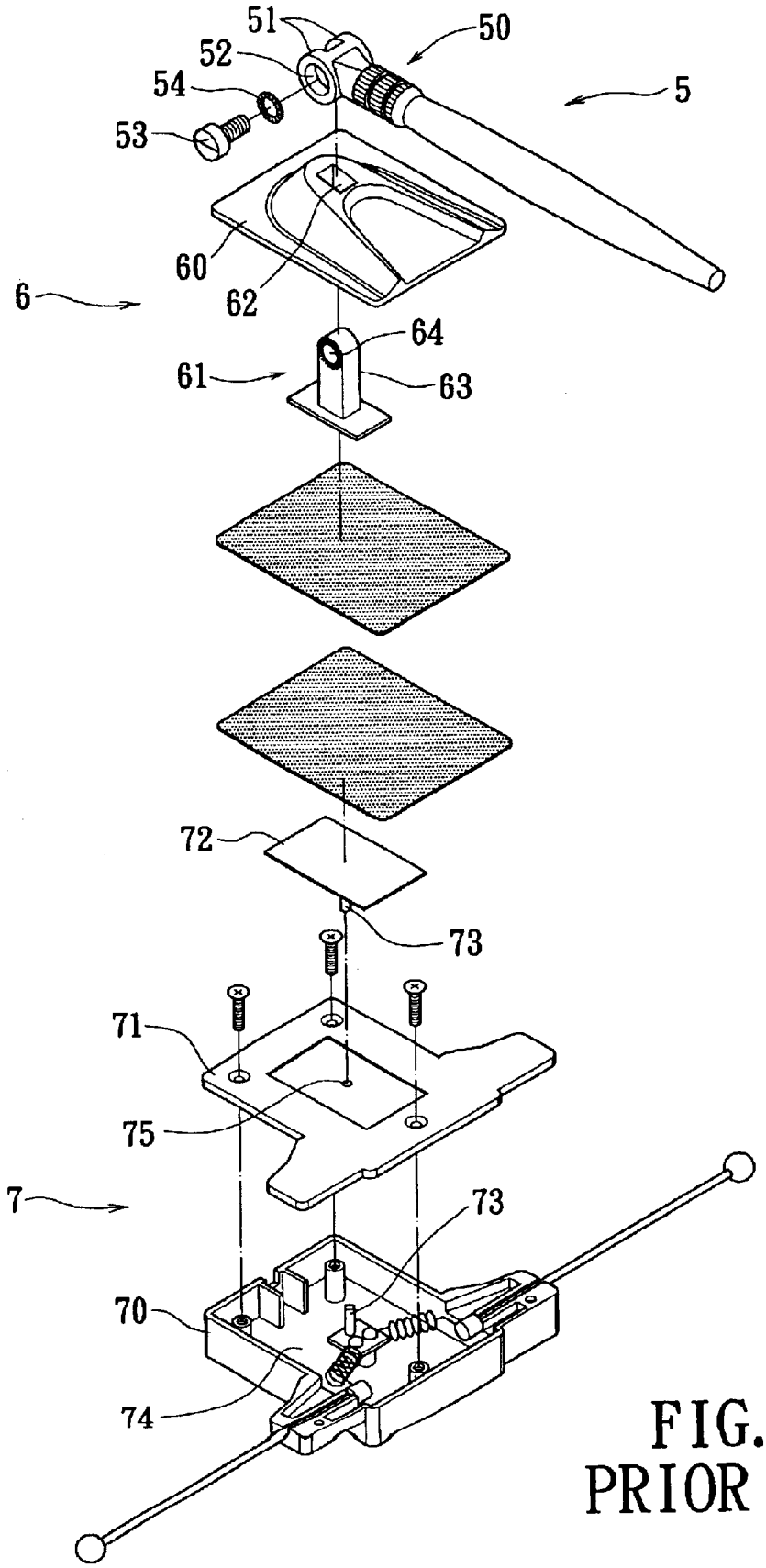
FIG. 1 PRIOR ART
FIG. 1 is an exploded view of an antenna for an automobile according to the prior art.
Figure 2:
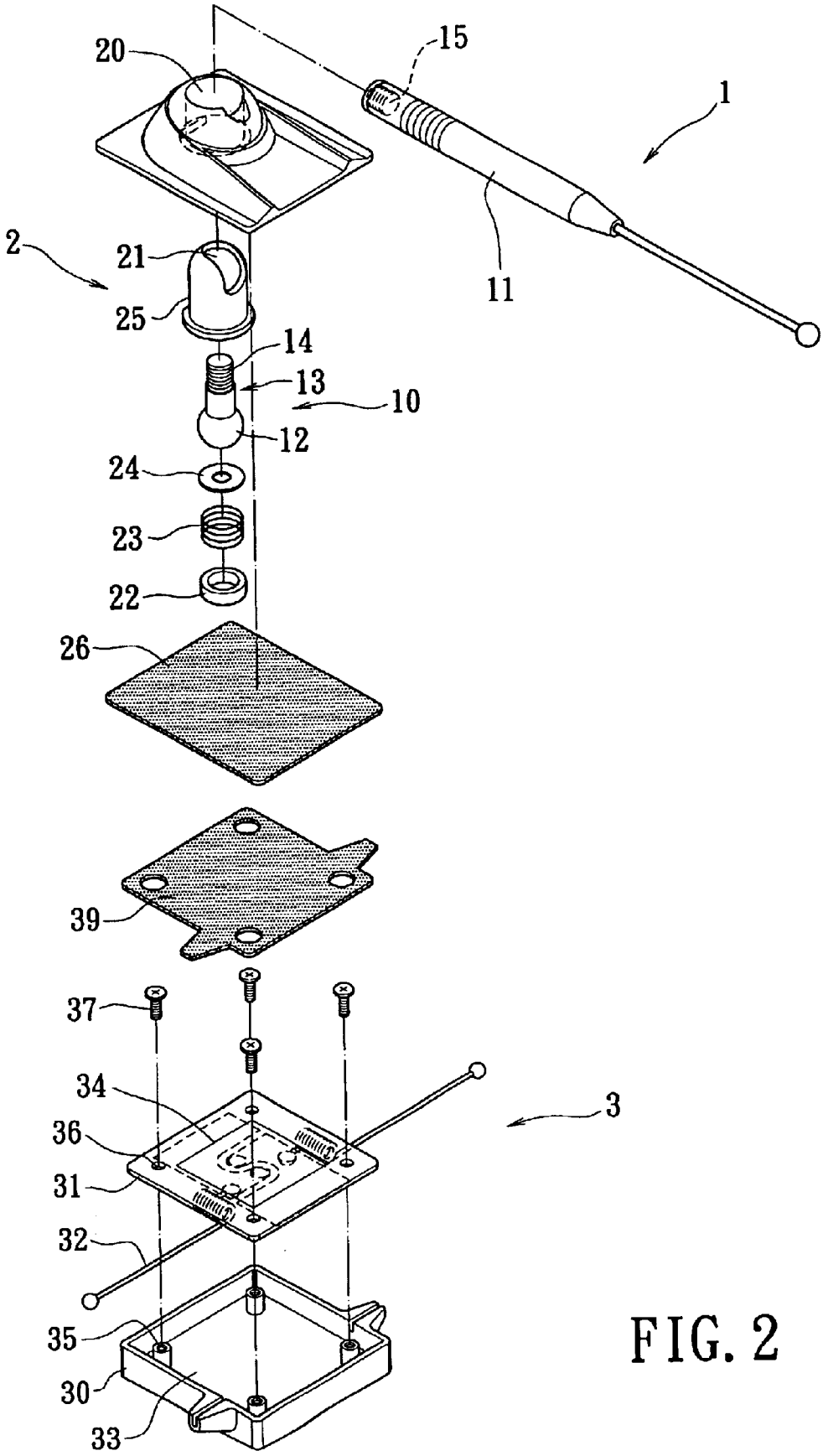
FIG. 2 is an exploded view of an antenna for an automobile according to the present invention.

Referring to FIG. 2, an antenna for an automobile in accordance with the present invention is shown and comprises an antenna terminal 1, a mounting base 2, and a transmission box 3.

The antenna terminal 1 comprises a tubular terminal body 11 and a connector 10, both made from copper. The terminal body 11 has an inner thread 15 in the bottom end. The connector tip 10 comprises a spherical coupling portion 12 and a shank 13 extending from the periphery of the spherical coupling portion 12. The shank 13 has an outer thread 14 threaded into the inner thread 15 of the terminal body 11.

The mounting base 2 comprises a holder shell 20, a metal ball socket 25, a metal block 22, a spring member 23 and a metal bearing member 24. The metal ball socket 25 is mounted in the holder shell 20 and holds the spherical coupling portion 12 of the connector 10 on the inside. The metal ball socket 25 has an opening 21 for the passing of the shank 13 of the connector 10. The metal block 22 is fixedly fastened to the holder shell 20 on the bottom side. The spring member 23 is supported on the metal block 22. The metal bearing member 24 supports the spherical coupling portion 12 of the connector 10 on the spring member 23. The spring member 23 forces the bearing member 24 against the spherical coupling portion 12 of the connector 10, holding the connector 10 and the antenna terminal 1 in position.

The transmission box 3 comprises a casing 30, a circuit board 31, a metal plate 34, and a transmission line 32. The casing 30 comprises a plurality of female screw rods 35 vertically suspended in four corners inside the receiving open chamber 33 defined in the casing 30. The circuit board 31 is supported on the female screw rods 35, having a plurality of screw holes 36 respectively fixedly connected to the female screw rods 35 by screws 37. The metal plate 34 built in one side of the circuit board 31 opposite the receiving open chamber 33, and is electrically connected to the transmission line 32.

Figure 3:
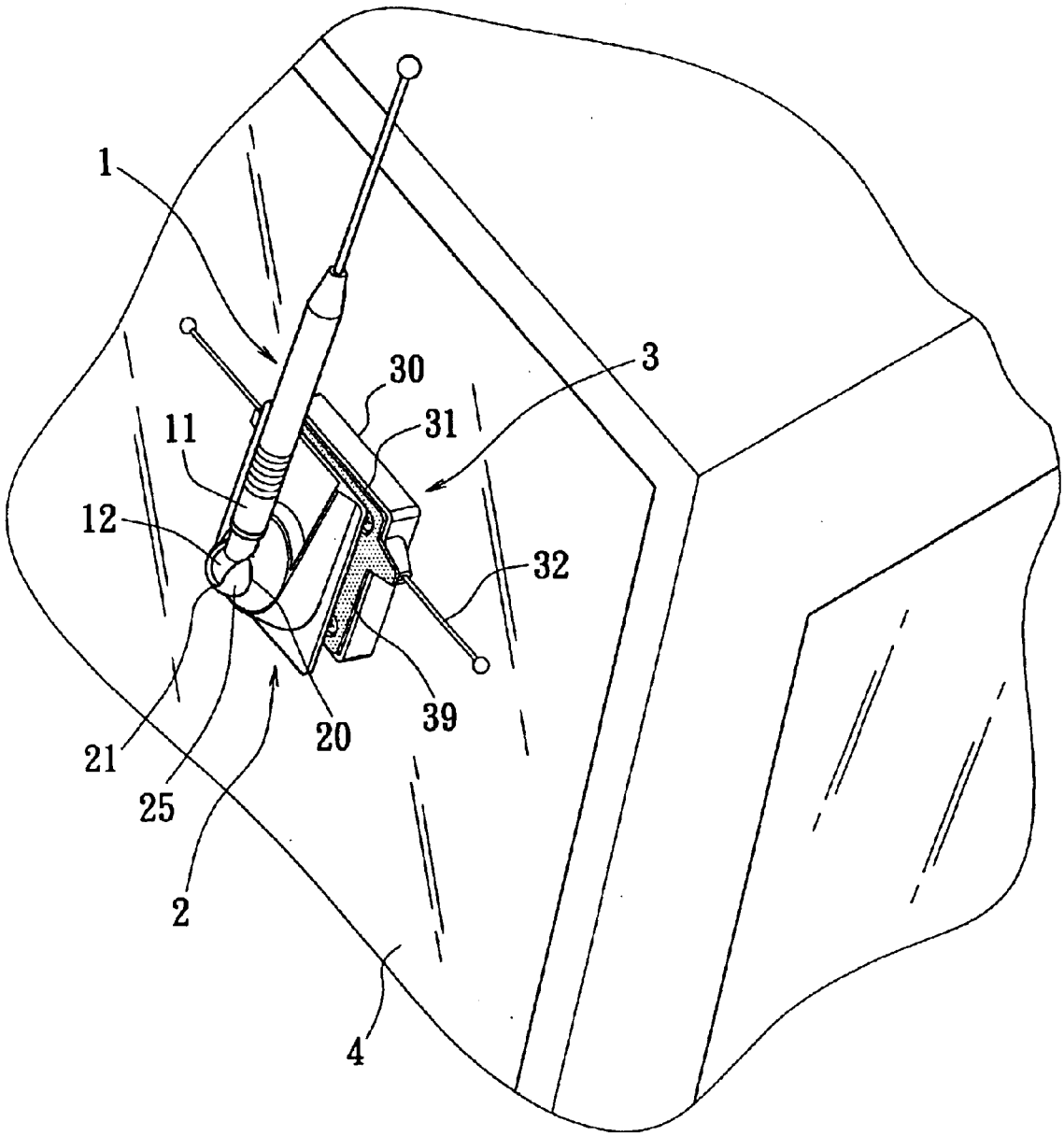
FIG. 3 is a view of the present invention showing the antenna installed in the windshield of an automobile.
Figure 4:
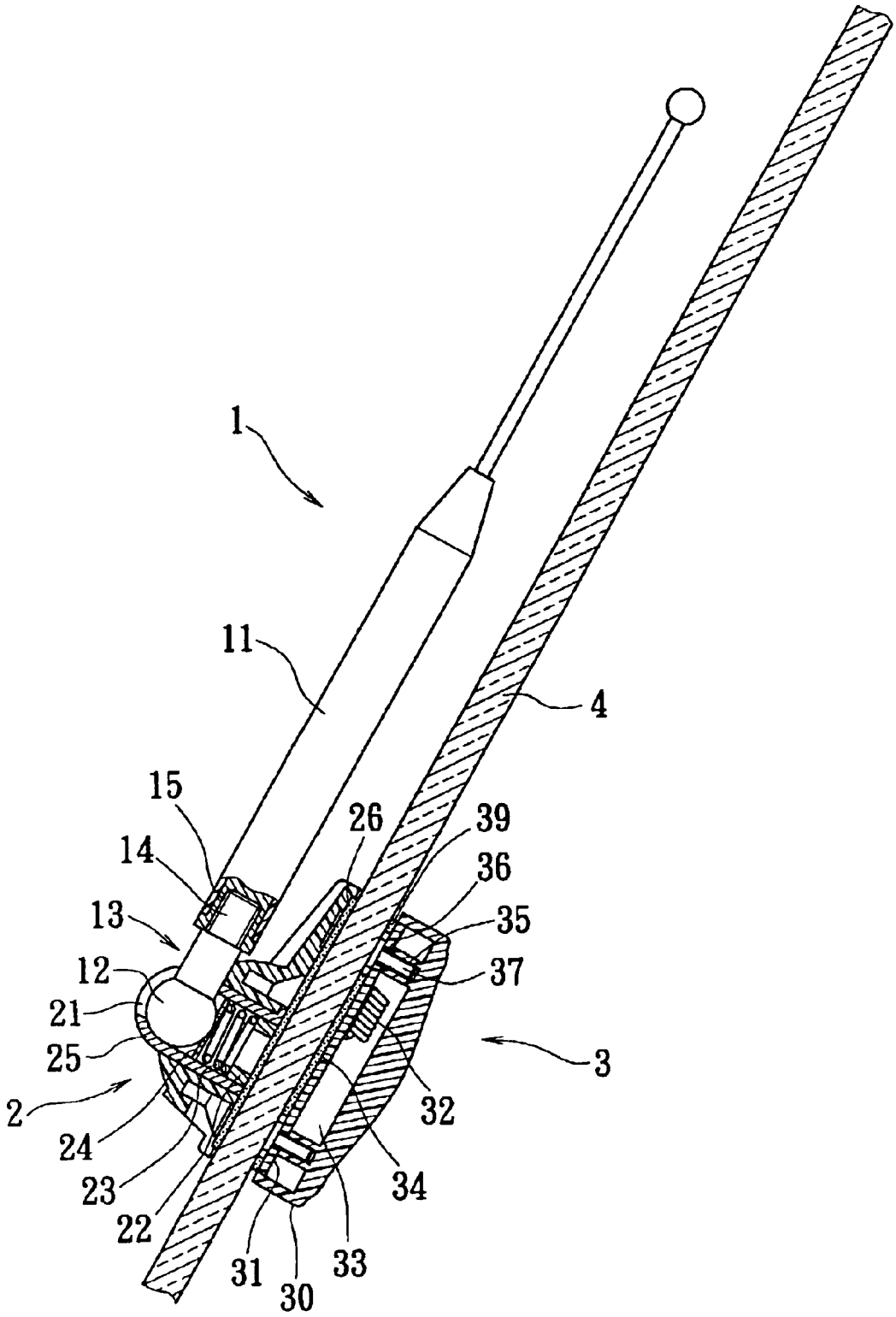
FIG. 4 is a cross-sectional side view with enlarged scale of the antenna according to the present invention.

Referring to FIGS. 3 and 4, during installation, the holder shell 20 of the mounting base 2 is fastened to the outer surface of the windshield 4 outside the automobile by a double-sided adhesive tape 26, and the metal plate 34 of the circuit board 31 is fastened to the inner surface of the windshield 4 inside the automobile by a double-sided adhesive tape 39. When installed, signal is transmitted between the antenna terminal 1 and the transmission line 32 through the mounting base 2 and the metal plate 34 via the windshield 4. The transmission line 32 is made in the form of a coil and extends out of the transmission box 3 to the on-board wireless communication system of the automobile, for example, GSM or CDMA.

Because the spherical coupling portion 12 of the connector 10 of the antenna terminal 1 pivots within the ball socket 25 inside the holder shell 20 of the mounting base 2 and is held down by the spring member 23 and the bearing member 24, the antenna terminal 1 does not move when the automobile travels over an uneven road surface and the user can adjust the antenna terminal 1 to the desired angle and position easily and directly by hand and without tools. Further, because the metal plate 34 is built in the circuit board 31 and the transmission line 32 is directly electrically connected to the circuit board 31, the whole structure of the transmission box 3 is simple.

Figure 5:
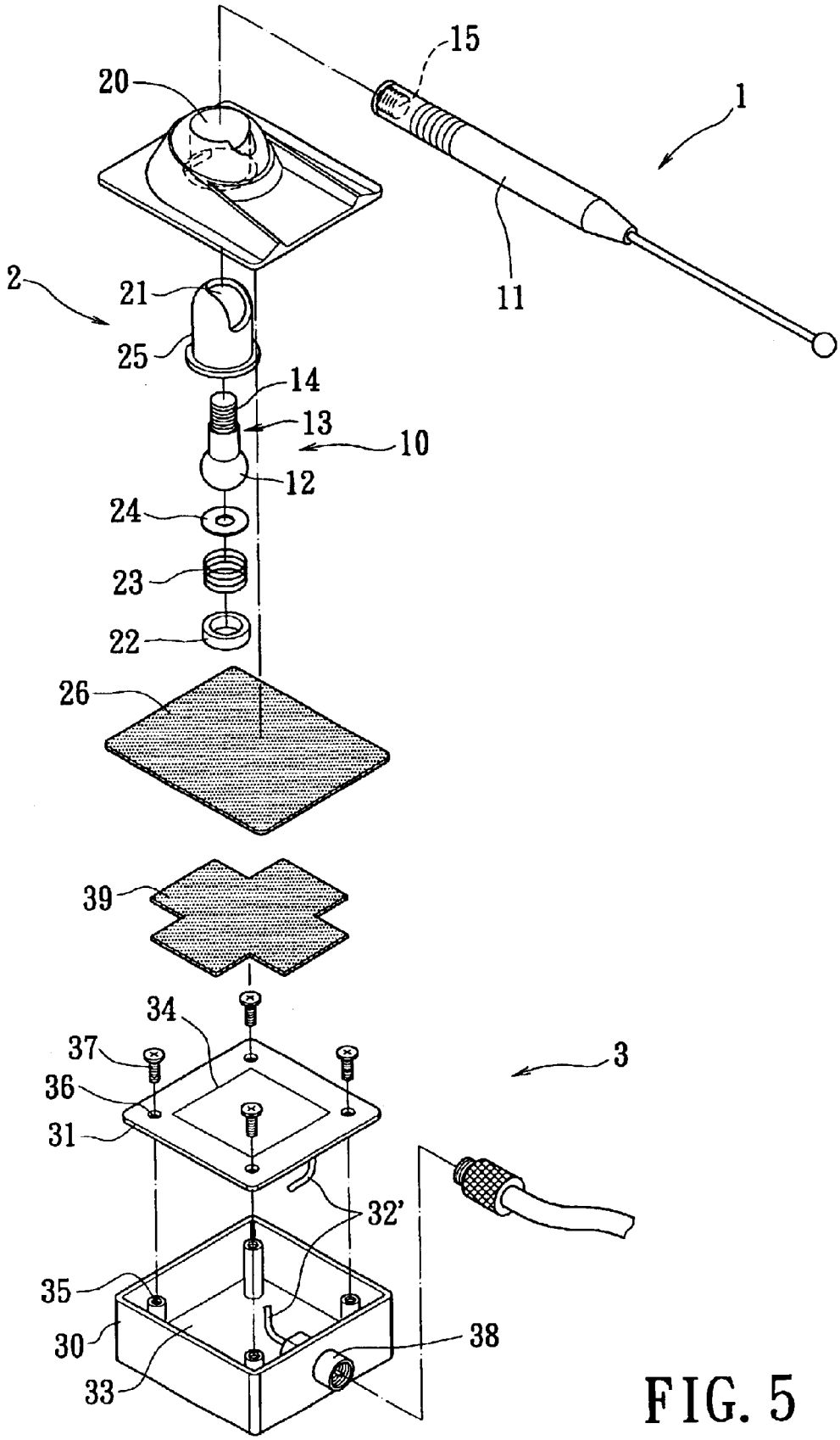
FIG. 5 is an exploded view of an alternate form of the antenna for an automobile according to the present invention.

FIG. 5 illustrates an alternate form of the antenna for an automobile according to the present invention. According to this alternate form, the transmission line 32' has one end terminating in a terminal connector 38, which is fixedly in the peripheral wall of the casing 30 for the connection of the cable of the wireless communication system of the automobile.

A prototype of antenna for an automobile has been constructed with the features of the annexed drawings of FIGS. 2~5. The antenna for an automobile functions smoothly to provide all of the features discussed earlier.

Although particular embodiments of the invention have been described in detail for purposes of illustration, various modifications, and enhancements may be made without departing from the spirit and scope of the invention. Accordingly, the invention is not to be limited except as by the appended claims.

What the invention claimed is:

1. An antenna for an automobile comprising:

an antenna terminal including a tubular metal terminal body, and a connector threadedly joined with the tubular metal terminal body, the connector having a solid spherical coupling portion and a shank extending from the periphery of the solid spherical coupling portion;

a mounting base including a holder shell and a metal ball socket, said metal ball socket being received and secured within the holder shell and further being hollow so as to hold the solid spherical coupling portion of the antenna terminal, an opening being formed through the metal ball socket so that the antenna terminal is received by said opening and extends out of the holder shell, a metal block being fixedly arranged at a bottom of the holder shell and being adapted for adhesion to an outer surface of a windshield of an automobile;

a metal spring for holding the solid spherical coupling portion of the antenna terminal in position, said metal spring simultaneously abutting both the metal block and a bearing member in direct contact with the solid spherical coupling portion of the antenna terminal; and, a transmission box disposed inside the automobile opposite the mounting base, the transmission box including a metal plate built in a circuit board that disposes in the transmission box and adheres to an inner surface of the windshield of the automobile, a transmission line electrically extending from the metal plate for connection to a wireless communication system inside the automobile.

2. The antenna as claimed in claim 1, wherein the tubular metal terminal body has an inner thread in an end thereof, and the shank has an outer thread threaded mating with the inner thread of the tubular metal terminal body.

3. The antenna for an automobile as claimed in claim 2, wherein the connector and the terminal body are respectively made from copper.

4. The antenna for an automobile as claimed in claim 1, wherein the transmission box further includes a casing defining a receiving open chamber that accommodates with the transmission box; the circuit board is mounted in the receiving open chamber of the casing and electrically connected to the transmission line, the metal plate is built in a side of the circuit board and opposite the transmission line.

5. The antenna for an automobile as claimed in claim 4, wherein the transmission line is a coil that receives in the receiving open chamber prior to extend out of the casing.

6. The antenna for an automobile as claimed in claim 4, wherein the transmission box includes a terminal connector that fixedly secures to a peripheral wall of the casing, the transmission line terminates in the terminal connector.

7. The antenna for an automobile as claimed in claim 4, wherein the casing includes a plurality of upright female screw rods projecting inside the receiving open chamber and adapted to support the circuit board and a plurality of screws corresponding to the upright female screw rods, respectively; the circuit board has a plurality of screw holes that correspond to the screws and the upright female screw rods in an one-on-one manner.

8. The antenna for an automobile as claimed in claim 1, wherein the holder shell of the mounting base has a double-sided adhesive tape adapted for a bottom side thereof to secure the metal block to the windshield of the automobile.

* * * * *